US007073298B1

(12) United States Patent
Phan

(10) Patent No.: US 7,073,298 B1
(45) Date of Patent: Jul. 11, 2006

(54) SOLID SHEAR PANEL FOR SUPPORTING A LIGHT-FRAMED STRUCTURE

(76) Inventor: Toan Phan, 735 Rock Rose Way, Richmond, CA (US) 94806

( * ) Notice: Subject to any disclaimer, the term of this patent is extended or adjusted under 35 U.S.C. 154(b) by 238 days.

(21) Appl. No.: 10/730,651

(22) Filed: Dec. 8, 2003

(51) Int. Cl.
*E04C 5/08* (2006.01)

(52) U.S. Cl. ..... 52/223.7; 52/223.6; 52/665.1; 52/665

(58) Field of Classification Search ..... 52/295–297, 52/698, 657, 655.1, 693, 665, 223.6, 223.7
See application file for complete search history.

(56) References Cited

U.S. PATENT DOCUMENTS 1,876,528 A 9/1932 Walters
3,638,377 A 2/1972 Caspe
5,375,384 A * 12/1994 Wolfson ..... 52/295
5,491,949 A * 2/1996 De Moor ..... 52/657
5,595,035 A 1/1997 Chang
5,660,007 A 8/1997 Hu et al.
5,862,639 A 1/1999 Abou-Rached
6,009,674 A * 1/2000 Root ..... 52/167.3
6,073,417 A 6/2000 Hackett
6,185,898 B1 * 2/2001 Pratt ..... 52/657
6,192,639 B1 2/2001 Germain

* cited by examiner

*Primary Examiner*—Carl D. Friedman
*Assistant Examiner*—Yvonne M. Horton
(74) *Attorney, Agent, or Firm*—Goldstein Law Ofiices P.C.

(57) ABSTRACT

A solid shear panel for supporting a structure having an upper edge, a lower edge and two side edges. The upper edge is secured to a horizontal double plate mounted beneath a beam underneath a floor surface of a structure, while the lower edge rests on a sill plate above ground level. The shear panel contains a plurality of vertically extending support posts having the same length. Sawn lumber, laminated wood, engineered wood, a metal such as steel or another suitable construction material can be utilized to form the support posts. Two steel plates press against the side edges of the shear panel and thereby compact the support posts together into a solid grouping of posts. A plurality of horizontally extending connecting bolts hold the posts together near the upper and lower edges of the shear panel.

5 Claims, 2 Drawing Sheets

SOLID SHEAR PANEL FOR SUPPORTING A LIGHT-FRAMED STRUCTURE

BACKGROUND OF THE INVENTION

1. Field of the Invention

The invention generally relates to a shear panel, and in particular it relates to a solid shear panel for supporting a building structure, both vertically and laterally.

2. Description of the Related Art

One of the most common methods of supporting a structure is also one of the most traditional: periodically spaced and vertically extending individual posts attached between upper and lower floor framings. This technique has been used in the construction of light-framed buildings for countless years. It has been utilized in light-framed structures such as private residences and small commercial buildings. Even today, the use of detached vertical posts to support the weight of newly constructed buildings remains commonplace. In fact, such posts remain the default option for many building contractors and subcontractors in residential and commercial developments alike.

However, this prevailing technique is not favored in areas that are highly susceptible to earthquakes and high winds. Traditional wood shear walls have very limited lateral capacities as prescribed in building codes. Thus, other more innovative methods must be employed in these cities and towns. More broadly, a nationally viable alternative design for use in communities of all types would be useful and highly desirable. Consequently, there is a need for a simple yet effective repeating framework upon which various structures can be solidly and securely built.

One structure often mandated by building codes in earthquake and high wind prone areas is the traditional wood shear wall, which employs a sheet of plywood extending between and nailing to wood studs. This structure, however, is not always feasible and effective, due to limited available wall length.

U.S. Pat. No. 1,876,528 to Walters ("Walters") teaches a metallic interior building wall structure. However, the structure of Walters cannot support the weight of a building.

U.S. Pat. No. 3,638,377 to Caspe ("Caspe") teaches an earthquake-resistant multi-story structure. However, the structure of Caspe does not pertain to single-story buildings and therefore has a limited application.

U.S. Pat. No. 5,491,949 to De Moor ("De Moor") discloses a cross bracing for wooden structures. However, the invention of De Moor does not pertain to metallic or other non-wooden buildings and therefore has a limited application.

U.S. Pat. No. 5,595,035 to Chang ("Chang") teaches a lightweight wall structure for use in buildings. However, the structure of Chang relies upon the traditional technique of supporting the weight of a structure with a series of detached posts.

U.S. Pat. No. 5,660,007 to Hu et al. ("Hu") discloses a stiffness decoupling assembly for the protection of buildings prone to earthquakes. However, Hu does not provide a basic framework that is capable of independently supporting structures.

U.S. Pat. No. 5,862,639 to Abou-Rached ("Abou-Rached") teaches an earthquake, fire and wind resistant pre-fabricated building panel comprising a plurality of frame members. However, the panel of Abou-Rached is excessively complex and unwieldy.

U.S. Pat. No. 6,009,674 to Root ("Root") discloses a method and apparatus for providing earthquake resistant modular structures. However, Root does not provide a basic framework that is capable of independently supporting structures.

U.S. Pat. No. 6,073,417 to Hackett ("Hackett") teaches a building system. However, the invention of Hackett is excessively complex and unwieldy.

U.S. Pat. No. 6,192,639 B1 to Germain ("Germain") teaches a structural system for erecting buildings. However, the structural system of Germain is intended to be utilized with single-family homes and therefore has a limited application.

While these devices may be suitable for the particular purposes employed, or for general use, they would not be as suitable for the purposes of the present invention as disclosed hereafter.

SUMMARY OF THE INVENTION

It is an object of the invention to provide shear panels upon which a structure can be solidly built. Accordingly, the shear panels can be properly spaced between the floor of a building before being secured to the floor framings.

It is another object of the invention to provide shear panels upon which a structure can be securely built. Accordingly, the panel is constructed of an arrangement of side-by-side support studs that are connected with transverse horizontal bolts. This solid construction of the shear panels can withstand the brunt of midsize earthquakes and similar seismic and high wind activity without collapsing.

It is a further object of the invention to provide a shear panel that can function effectively with support studs made of various materials. Accordingly, the support studs of the shear panel can be constructed from numerous woods and metallic alloys.

It is a further object of the invention to provide a shear panel that is firmly held together. Accordingly, steel plates are pressed against both side edges grouping of support studs of the of the shear panel by the horizontal transverse bolts.

The invention is a solid shear panel for supporting a structure having an upper edge, a lower edge and two side edges. The upper edge is secured to a horizontal double plate mounted beneath a beam underneath a floor surface of a structure, while the lower edge rests on a sill plate above ground level. The shear panel contains a plurality of vertically extending support studs having the same length. Sawn lumber, laminated wood, engineered wood or light-gage metal can be utilized to form the support studs. Two steel plates press against the side edges of the shear panel and thereby compact the support posts together into a solid grouping of studs. A plurality of horizontally extending connecting bolts hold the studs together and are equally spaced throughout the height of the shear panel.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
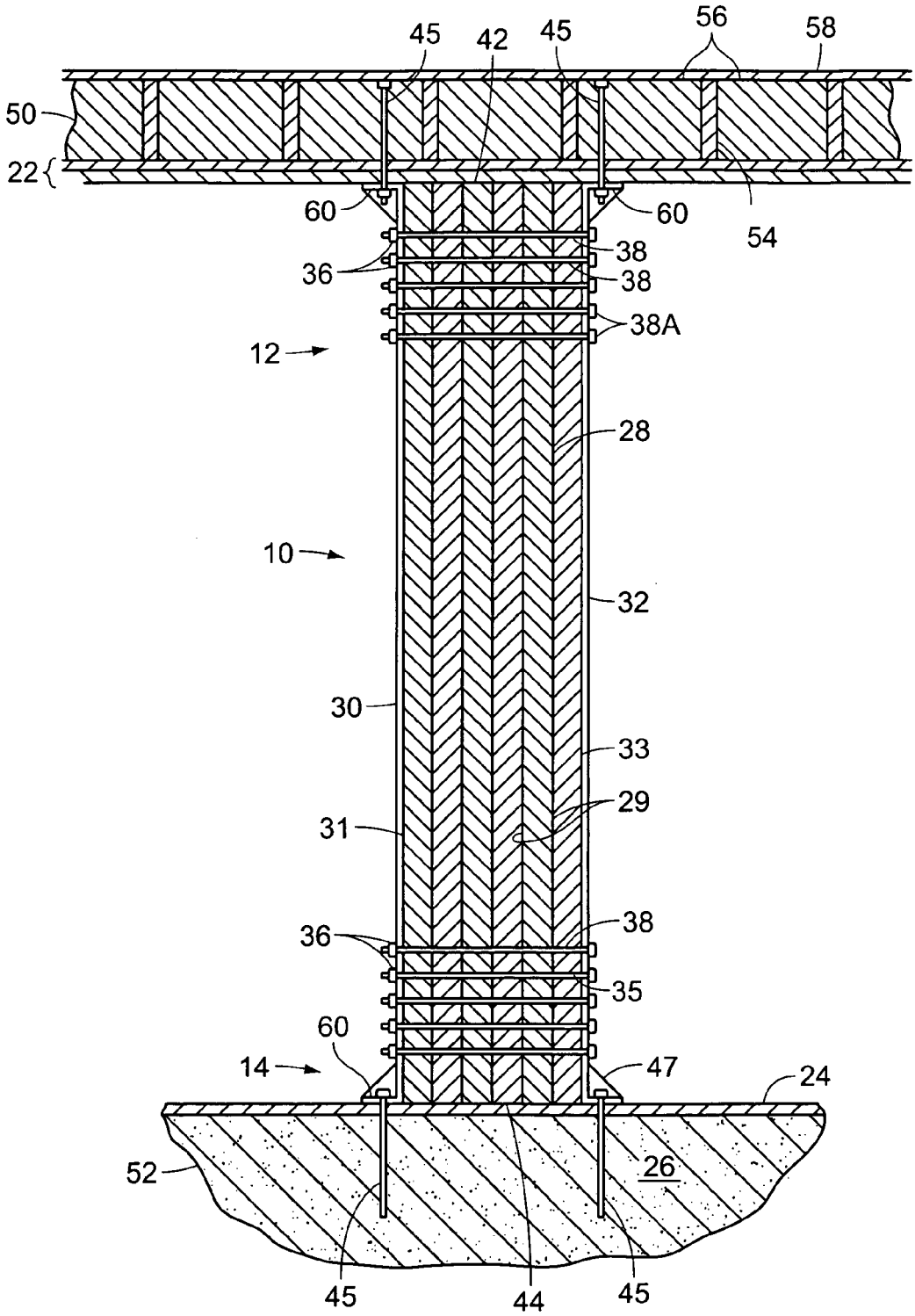
FIG. 1 is a cross-sectional view with parts cut away of a shear panel according to the present invention attached within a building structure, anchored between upper and lower horizontal surfaces.

FIG. 1 presents a cross-sectional view with parts cut away of a shear panel 10 according to the present invention installed within a building structure 11. The building structure has a horizontal overhead structure 50 and a base structure 52. The shear panel 10 can be conceptually divided into a top end 12 and a bottom end 14 whereas the bottom end is situated upon the base structure 52 and the top end is located below and at least partially supports the horizontal overhead structure 50.

The shear panel 10 has an upper edge 42, a lower edge 44 and two side edges 31 and 33. According to the present invention, a plurality of solid support posts 28 extend longitudinally between the upper edge 42 and lower edge 44. The solid support studs 28 each have a pair of sides 29. The support studs 28 are configured in a solid arrangement of support studs 28, such that the sides 29 of the support posts 28 are positioned tightly against each other. The support posts 28 can be manufactured from sawn lumber, laminated wood, engineered wood, a light-gage metal or another suitable construction material. All of the support studs 28 have the same length and have a solid construction throughout. Thus, the shear panel 10 is "solid" between the upper edge 42 and lower edge 44, and between its two side edges 31 and 33.

The horizontal overhead structure 50 includes a plurality of floor joists 54 that are separated by solid blocking 56, covered by floor sheathing 58, and situated upon a double top plate 22. The base support, 52 in this case, includes a foundation 26 that is covered by a sill plate 24.

The shear panel 10 is secured at the upper edge 42 to the double plate 22 with vertical bolts 45 that extend into the blocking 56. The shear panel 10 is mounted at its lower edge 44 to the sill plate 24 with vertical bolts 45 that extend into the foundation 26.

More particularly, the shear panel 10 has a pair of side plates 30, 32 that extend along the side edges 31, 33. The side plates 30 are preferably made of a metallic material such as steel, and extend fully between the upper edge 42 and lower edge 44. The side plates 30, 32 each have hold down flanges 60 that extend laterally outward at the upper edge 42 and lower edge 44, perpendicular to said side plate. The vertical bolts 45 extend through the hold down flanges 60 to secure the side plates to the horizontal overhead structure 50 and the base structure 52. The side plates 30, 32 hold the support posts 28 together with a plurality of horizontal connecting bolts 38 that extend through each of the posts 28 and through both of the side plates 30, 32. Accordingly, the horizontal connecting bolts 38 hold the side plates 30, 32 and posts 28 together into one rigid unit. Each post 28 has a plurality of transverse holes 35 extending between its sides 29. Each transverse hole 35 is sized to accommodate one of the connecting bolts 38. The transverse holes 35 are located at equivalent positions along the length of all of the posts 28. The connecting bolts 38 each have a head 38A, and are secured opposite the head with a nut 36. In general, the head 38A and nut 36 are outermost among the side plates 30, 32 and posts 28. It should be noted that the number of posts 28 employed could be varied significantly. In fact, one large post can span fully between the side plates 30, 32.

Figure 2:
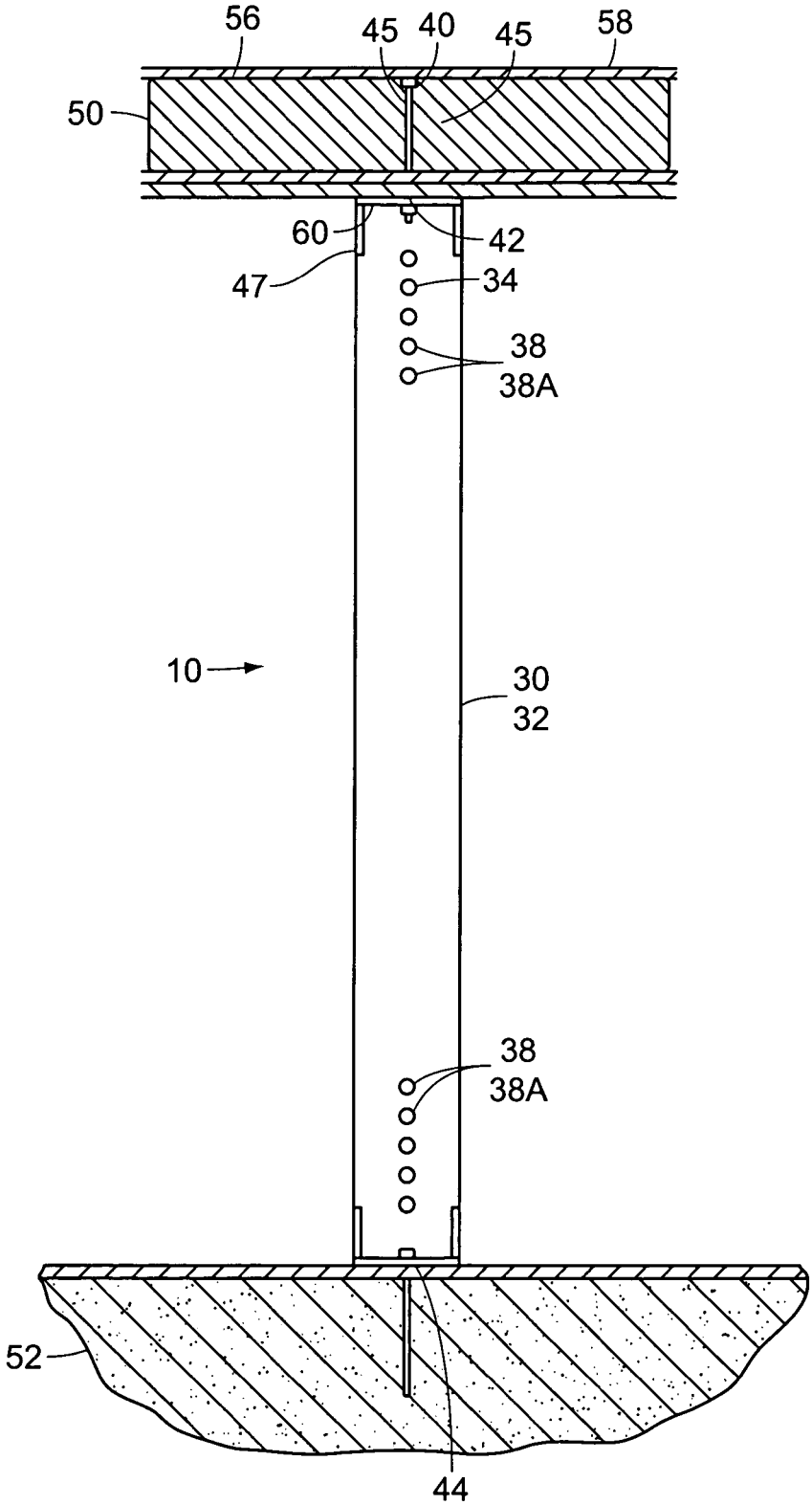
FIG. 2 is a side elevational view of the shear panel, showing the transverse bolts attached against the side panels.

FIG. 2 depicts a side elevational view of the shear panel 10. The heads of the bolts 38A near the upper edge 42 and the lower edge 44 respectively are clearly visible. Preferably, a plurality of bolts 38 are located near each of the upper edge 42 and lower edge 44. Also illustrated is how the two vertical bolts 45 extend through the hold down flange 60 of each of the plates 30 or 32 to secure the shear panel to the horizontal overhead structure 50 and base structure 52. The bolts are secured in the blocking with a fastener 40 that may be counterbored into the blocking 56 to allow the floor sheathing 58 to extend evenly thereabove. In addition a fin 47 extends at a substantially forty five degree angle between each hold down flange 60 and its associated side plate 30 or 32, between the vertical bolts 45 to lend structural strength to the interconnection between the hold down flange 60 and the side plate 30 or 32.

Installation of the shear panel in a building structure involves aligning the transverse holes of the posts by grouping the posts side by side. Then the side panels are positioned alongside the posts so that the connecting bolts can be extended through the transverse holes of the posts and through the side panels to secure the posts together and the side panels to the posts. The shear panel is then secured to the base structure and to the upper support structure by extending the vertical bolts through the hold down flanges, and through the double plate at the upper edge of the shear penal, and through the sill plate at the lower edge of the shear panel. The shear panel is covered by wall sheathing, such as sheetrock, in a conventional manner, such that the wall sheathing extends fully across the posts and the side panels—perhaps to an adjacent shear panel.

In conclusion, herein is presented a solid shear panel for supporting a structure. The invention is illustrated by example in the drawing figures, and throughout the written description. It should be understood that numerous variations are possible, while adhering to the inventive concept. Such variations are contemplated as being a part of the present invention.

What is claimed is:

1. A solid shear panel for supporting a building structure having a base support and horizontal overhead structure having a double plate, comprising:

an upper edge for positioning beneath the horizontal overhead structure, the upper edge is secured to the double plate with vertical bolts;

a lower edge for positioning upon the base support secured to a sill plate above ground level;

two side edges;

a plurality of vertically extending support posts having the same length and extending fully between the lower edge and upper edge, the vertically extending support posts each having a plurality of transverse holes extending at the same positions on each of the posts, the support posts extending immediately adjacent to each other such that the transverse holes are aligned between the posts;

two side plates that extend fully between the upper edge and lower edge at the side edges and press the support posts together into a solid unit between the side edges; and a plurality of connecting bolts extending horizontally through the side plates and through the transverse holes of all of the support posts for holding the side plates against the support posts and the support posts against each other.

2. The solid shear panel as recited in claim 1, wherein each side plate has a pair of hold down flanges extending perpendicularly from the upper edge and lower edge, wherein the vertical bolts extend through the hold down flanges.

3. The solid shear panel as recited in claim 2, wherein the support posts are constructed solid wood selected from sawn lumber, laminated wood, and engineered lumber.

4. The solid shear panel as recited in claim 3, wherein the side plates are made of a metallic material.

5. A building support method, for supporting an horizontal overhead structure above a base support, using a shear panel having a plurality of posts each having a plurality of transverse holes, a pair of side panels, each side panel having hold down flanges extending perpendicularly therefrom at each of the upper edge and lower edge, and using a plurality of connecting bolts and nuts, comprising the steps of:

aligning the transverse holes of the posts by grouping the posts side by side;

positioning the side panels alongside the posts;

extending the connecting bolts through one of the side panels, through the transverse holes of the posts, and through the other of the side panels;

securing the posts together by securing each of the connecting bolts with a nut;

securing the side panels to the base support with vertical bolts by extending the vertical bolts through the hold down flanges;

securing the side panels to the horizontal overhead structure with vertical bolts by extending the vertical bolts through the hold down flanges; and sheathing across the shear panel, covering the posts.

* * * * *